United States Patent [19]

Krause et al.

[11] 4,120,273

[45] Oct. 17, 1978

[54] STARTING AID FOR INTERNAL COMBUSTION ENGINES

[75] Inventors: Walter Krause, Rösrath-Stümpen; Peter Bober, Cologne; Eckhard Haas, Porz-Ensen, all of Fed. Rep. of Germany

[73] Assignee: Klockner-Humboldt-Deutz Aktiengesellschaft, Cologne, Fed. Rep. of Germany

[21] Appl. No.: 678,888

[22] Filed: Apr. 21, 1976

[30] Foreign Application Priority Data

Apr. 24, 1975 [DE] Fed. Rep. of Germany ..... 2518156

[51] Int. Cl.[2] ..... F02M 7/00; F02B 3/00

[52] U.S. Cl. ..... 123/122 G; 123/179 H

[58] Field of Search ..... 123/122 G, 122 D, 179 H; 432/222

[56] References Cited

U.S. PATENT DOCUMENTS

| | | | |
|---|---|---|---|
| 1,669,979 | 5/1928 | Good | 123/122 G |
| 2,915,377 | 12/1959 | Reichhelm | 123/122 G |
| 3,561,413 | 2/1971 | Zurner | 123/179 H |

FOREIGN PATENT DOCUMENTS

| | | | |
|---|---|---|---|
| 2,047,589 | 4/1972 | Fed. Rep. of Germany | 123/179 H |
| 491,465 | 6/1919 | France | 123/122 G |

*Primary Examiner*—Ronald B. Cox

*Attorney, Agent, or Firm*—Walter Becker

[57] ABSTRACT

Starting aid for internal combustion engines according to which fuel is conveyed to a flame heater plug extending into the interior of an outwardly bulging section of the air intake manifold which bulging section is larger than the entire plug portion extending into the bulging section of the air intake. A perforated cover is interposed between the flame heater plug and the air intake manifold, and more specifically is located in the area where the bulging section of the air intake manifold bulges out from the latter.

11 Claims, 2 Drawing Figures

STARTING AID FOR INTERNAL COMBUSTION ENGINES

The present invention relates to a starting aid for internal combustion engines, according to which a flame heater plug or flame glow plug extends into the air intake or suction pipe. Fuel is supplied to and ignited by the heater plug.

As a starting aid with internal combustion engines at low temperatures, it is preferable to preheat the air to be used for combustion. To this end, electrically heated element wires are installed into the air intake pipe. The passing air to be used for combustion is warmed up on the element wires. Since the high filament energy must be taken from the battery, there is not always enough energy available to simultaneously crank the engine by an electrical starter. Since, of course, battery capacity or efficiency always declines more and more at low temperatures, the power necessary to start the engine is hardly available.

When preheating the air to be used for combustion with a flame heater plug, a small amount of finely atomized or vaporized fuel is injected into the air intake pipe and ignited.

With a plurality of in-line cylinders, during the starting phase a very high air velocity occurs in the air intake pipe with increasing speed, so that the flame is blown away from the flame heater plug and only burns at the end of the air intake pipe or is extinguished entirely. Under these starting conditions, at best only those cylinders at the end of the air intake pipe are supplied with air to be used for combustion that has been preheated, while the first or front cylinders do not ignite and are dragged along. As the temperature decreases, the starting conditions become worse, so that a disproportionately long time passes before the required power to start the engine is obtained, during which time both a great amount of exhaust smoke and so-called white smoke are to be observed.

In order to prevent extinction of the flame durig strong air flow, the lower section of the flame heater plug has already (German Offenlegungsschrift No. 1,776,227) been surrounded or enclosed by a protecting cap which, on that side which faces away from the stream or flow, has an opening for the escape or exit of the flame. During large flow velocities, as they occur in the air intake pipe of tandem or in-line engines having several consecutively arranged cylinders, such a protecting cap does not suffice to maintain an undisturbed flame.

It is an object of the present invention, using convenient means, to ensure the preheating of the intake air at low temperatures, so that a short run-up time prior to load assumption will result, as well as a comparatively small formation of smoke.

This object and other objects and advantages of the present invention will appear more clearly from the following specification in connection with the accompanying drawing, in which.

Figure 1:
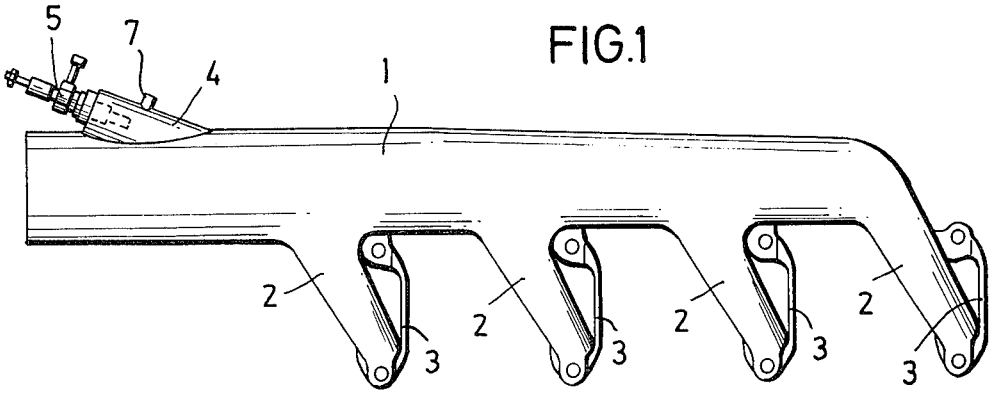
FIG. 1 shows an air intake pipe according to the present invention of a four-cylinder in-line engine.

The starting aid according to the present invention is characterized primarily in that the flame heater plug is mounted on a local bulge of the air intake pipe which is confined to a portion of the circumference thereof. This bulge is larger than the entire portion of the flame heater plug which extends into the interior of the air intake pipe. The mouth or opening of the local bulge into the air intake pipe is covered by an apertured or perforated plate. The flame heater plug is protected by being positioned in the bulge of the air intake pipe outside the strong flow in the intake pipe, so that an undisturbed flame can develop. By means of the apertured plate which closes off the bulge, the flame is shielded on the one hand from too strong a flow and from the pulsating pressure in the air intake pipe, and on the other hand, without disruption and well dispersed over a larger surface, the flame enters the air stream from the openings of the apertured plate. In order to assure that during cold starting, the temperatures in the cylinder rise rapidly and favorable operating conditions can be achieved as quickly as possible, it is proposed that a damper or throttle valve be installed in the exhaust manifold. The backing up of combustion gas back to the cylinders, brought about by the damper, allows the temperatures in the cylinders to rise very fast. At the same time in the air intake pipe, due to the filling of the cylinders with less intake air, the flow velocity is kept smaller and the efficiency of the flame heater plug is particularly aided.

An especially favorable position of the flame heater plug is realized by arranging the plug in the air intake pipe at a distance from where the air intake pipe merges with the inlet of the cylinder head; also, the longitudinal axis of the flame heater plug when viewed in the direction of flow forms an acute angle, but not exceeding 90°, with the longitudinal axis of the air intake pipe. In order to adjust to the cylinder size, the quantity of air, and the air intake pipe cross section, it is proposed according to the present invention that a plurality of flame heater plugs be mounted in the same local bulge, that the aperture size of the apertured plate be about 5 to 12 mm, and that the aperture interval of staggered or offset rows be one to two times that of the aperture diameter.

Pursuant to a further development of the present invention, a screened plate is mounted in the air intake pipe before the local bulge when viewing in the direction of flow. Although in this way the flow is in fact disturbed in the vicinity of the apertured plate, by means of the turbulence, however, a favorable mixture of the flames with the fresh intake air is achieved. In order to supply sufficient oxygen to the local bulge of the air intake pipe when required to maintain the flame, it is further proposed according to the present invention that an additional air channel discharges into the local bulge. This air channel may be branched off as a bypass to the air intake pipe or branched off directly from the air filter.

To assist the flame heater plug, it is advantageous to additionally provide a spark or ignition plug with spark gap adjacent to the flame heater plug to ignite the injected fuel. In this connection, the filament power of the flame heater plug may be reduced and a longer operating time for the sensitive heating element of the flame heater plug may be achieved.

As further supplementary means for achieving a stable flame which is not extinguished even with great flow velocities in the air intake pipe, it is proposed according to the present invention that the area where the local bulge leads into the air intake pipe be covered by a screen which may be heated electrically.

Referring now to the drawing in detail, the arrangement shown therein comprises a longitudinal section of an air intake pipe or manifold 1 of a four-cylinder in-line engine. Along the length of the air intake pipe 1 are four successive branches 2 which lead to the individual cylinder heads, not shown, to which they are connected by means of flanges 3. In the front part of the air intake pipe 1 at some distance from the first branch 2, a flame heater plug 5 is mounted in a local bulge 4. The bulge 4 is larger than that portion of the flame heater plug 5 which extends into the air intake pipe 1 and is so formed that, viewed in the direction of flow, the flame heater plug 5 forms an acute angle with the longitudinal axis of the air intake pipe 1. Other angular positions, up to a maximum of 90°, are just as possible. Depending upon the size of the air intake pipe 1, two flame heater plugs 5 may be arranged next to each other.

Figure 2:
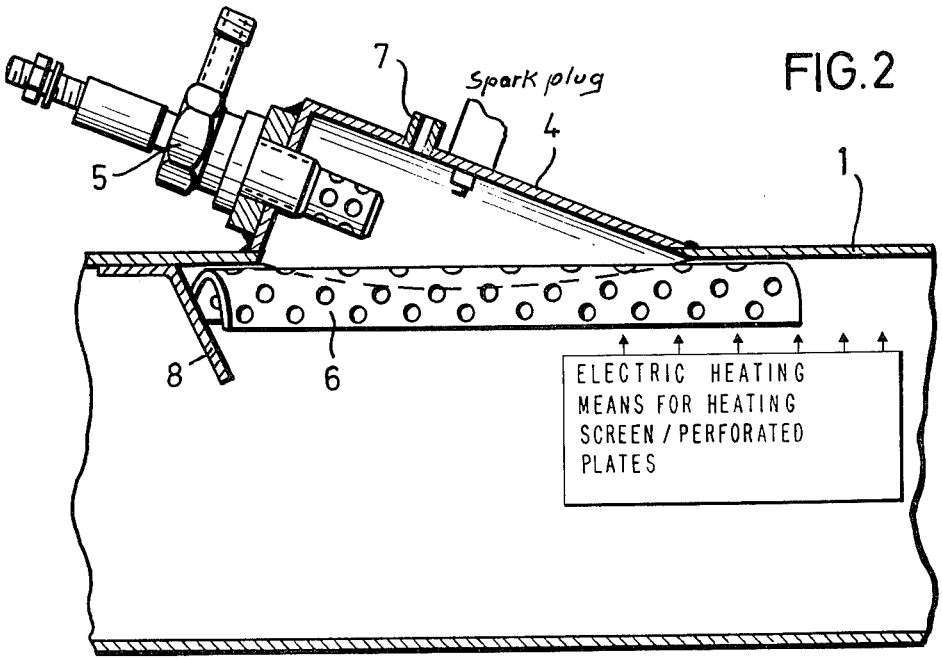
FIG. 2 shows on a larger scale than FIG. 1 a longitudinal section through the upper front part of the air intake pipe of FIG. 1.

FIG. 2 shows a longitudinal section through the forward portion of the air intake pipe 1. The area where the local bulge 4 leads into the air intake pipe 1 is covered by an apertured or perforated plate 6. In place of the plate 6, a screen may be used. The selection of the apertured plate or the screen requires an adaptation of the aperture cross section or mesh size to the size of the air intake pipe, to the air velocity, and to the injection or propellant volume of the flame heater plug.

During the starting process, along with turning over the engine, fuel is supplied to the flame heater plug 5. The plug 5 is sprayed with vaporized fuel from a nozzle and the fuel is ignited by a glow pin. The local bulge 4 together with the apertured plate 6, shields the flames extending from the flame heater plug from the strong air stream in the air intake pipe 1 to such an extent that the flame is not extinguished and passes out of the holes of the apertured plate 6 into the air intake pipe 1. By means of a screening plate 8, which, when viewed in the direction of flow, is mounted ahead of the apertured plate 6, turbulence is generated, so that a good mixing of intake air with the flames coming from the apertured plate 6 is assured. At the same time, in veiw of said turbulence, enough air is supplied to the flames in the local bulge 4 through the apertured plate 6 that combustion is maintained.

A particularly effective starting aid results in combination with a not further illustrated exhaust gas throttle in the exhaust manifold. As a result thereof, a backing up of the exhaust gases as far back as the working cylinders is effected, whereby at the same time the flow velocity in the air intake pipe 1 is decreased and a better preheating of the intake air as well as a higher temperature of the cylinder filling by means of the residual gases is achieved.

If a shortage of oxygen occurs, intake air may be supplied to the space formed by the bulge 4 and the apertured plate 6 through an auxiliary air conduit 7, which may be branched off as a bypass from the forward section of the air intake pipe or from the air filter. In order to still ignite the vaporized fuel with surety even under very bad conditions, expecially low temperatures, a spark plug having a spark gap may be mounted near the flame heater plug 5. Such an additional ignition aid allows the heating element of the flame heater plug to heat up less severely, so that a longer life or operating time results for this particularly highly stressed part.

Another possibility at extremely low temperatures for favorably affecting the inflammability of the vaporized fuel results from electrically heating the screen, which may be used in place of the apertured plate 6 to cover the bulge 4.

It is, of course, to be understood that the present invention is, by no means, limited to the specific showing of the drawing, but also comprises any modifications within the scope of the appended claims.

What we claim is:

1. For use in preheating combustion air compressed with an internal combustion injection engine without a carburetor, a starting aid which includes in combination: a straight air intake pipe leading to at least one branch pipe to a combustion cylinder, for conveying air to said engine, said air intake pipe being provided with an outwardly bulging section in a straight wall upstream of the air flow to said branch to form a chamber opening into the air intake pipe, at least one flame heater plug extending from the outside of the upstream end of said bulging section into the interior of said upstream end of said outwardly bulging section of said air intake pipe and disposed entirely within said chamber for preheating the entire air flow in said air intake pipe to a very high temperature at a value still below that for self ignition of a fuel mixture which is to be avoided, said bulging section being largest in cross section at its upstream end and tapering in the direction of air flow to a smaller cross section at its downstream end, so that the heated air from said flame heater plug will enter directly into said air intake pipe, and an apertured plate with a plurality of apertures throughout its length placed in the opening where said bulging section bulges out from said air intake pipe to separate said chamber from the air flow in the adjacent portion of said air intake pipe so the air flow does not interfere with the action of the flame heater plug and to maintain a reduced temperature while permitting communication therebetween through the apertures of said apertured plate to assure preheating stability without extinguishing said flame heater plug regardless of low starting temperatures and regardless of increasing speed to attain operation with smoke-free combustion, a portion of said air in said intake pipe entering through some of said perforations for combustion in said bulge and exiting said bulge through others of said perforations.

2. An arrangement according to claim 1, in which said outwardly bulging section is larger than that entire portion of said flame heater plug which extends into the interior of said bulging section.

3. An arrangement according to claim 1, which includes exhaust gas collecting pipe means and a throttle valve arranged in said pipe means.

4. An arrangement according to claim 1, in which said flame heater plug is arranged in spaced relationship to the area where said bulging section bulges out from said air intake pipe, the longitudinal axis of said flame heater plug forming an angle not exceeding 90° with the longitudinal axis of said air intake pipe when viewed in the direction of air flow through said intake pipe.

5. An arrangement according to claim 1, in which the diameter of the perforations of said perforated cover means is within the range of from 5 to 12 mm.

6. For use in connection with an internal combustion engine, a starting aid which includes: an air intake pipe for conveying air to said engine, said air intake pipe being provided with an outwardly bulging section, at least one flame heater plug extending from the outside of said bulging section into the interior of said outwardly bulging section of said intake pipe, and perforated cover means placed in the area where said bulging section bulges out from said air intake pipe so as to separate said bulging section from the adjacent portion of said intake pipe while permitting communication therebetween through the perforations of said perforated cover means, and the diameter of the perforations of said perforated cover means being within the range of from 5 to 12 mm, said perforated cover means having at least two rows of perforations with the perforations of one row offset with regard to the perforations of the adjacent row, the distances between adjacent perforations of each row being from one to two times the diameter of said perforations.

7. For use in connection with an internal combustion engine, a starting aid which includes: an air intake pipe for conveying air to said engine, said air intake pipe being provided with an outwardly bulging section, at least one flame heater plug extending from the outside of said bulging section into the interior of said outwardly bulging section of said intake pipe, and perforated cover means placed in the area where said bulging section bulges out from said air intake pipe so as to separate said bulging section from the adjacent portion of said intake pipe while permitting communication therebetween through the perforations of said perforated cover means, and shielding plate means extending in said air intake pipe at an angle to the longitudinal axis thereof ahead of said outwardly bulging section when viewing in the direction of intended air flow through said intake pipe.

8. An arrangement according to claim 7, which includes auxiliary conduit means leading to said bulging section for conveying fresh air thereinto.

9. An arrangement according to claim 7, which includes a spark plug with spark gap arranged adjacent said flame heater plug.

10. An arrangement according to claim 7, in which said perforated cover means is formed by a screen.

11. An arrangement according to claim 10, which includes electric heating means for heating said screen.

* * * * *